United States Patent [19]

Normandin

[11] 4,432,543

[45] Feb. 21, 1984

[54] PHYSIOTHERAPEUTIC SELF-EXERCISER

[76] Inventor: Michel Normandin, 1328 Nelles, Ste-Foy Quebec, Canada

[21] Appl. No.: 351,617

[22] Filed: Feb. 24, 1982

[51] Int. Cl.[3] ..... A63B 21/00

[52] U.S. Cl. ..... 272/126; 128/25 R

[58] Field of Search ..... 272/96, 94, 126, 143, 272/DIG. 5, 70; 128/25 R, 25 B, 779, 80 DB; 73/379–381

[56] References Cited

U.S. PATENT DOCUMENTS

| | | | |
|---|---|---|---|
| 2,772,881 | 12/1956 | Fundom | 272/126 |
| 2,815,020 | 12/1957 | Barkschat | 128/25 R |
| 3,566,861 | 3/1971 | Weiss | 272/126 X |

FOREIGN PATENT DOCUMENTS

| | | | |
|---|---|---|---|
| 2439402 | 3/1976 | Fed. Rep. of Germany | 272/96 |

*Primary Examiner*—Richard J. Apley
*Assistant Examiner*—William R. Browne
*Attorney, Agent, or Firm*—Cushman, Darby & Cushman

[57] ABSTRACT

The disclosure describes a physiotherapeutic self-exerciser which enables a patient to apply himself traction to the muscles or tendons of his feet; the exerciser includes a sabot to which the patient's foot is attached and a pair of levers which are manually engageable by the patient; the patient gradually applies his weight to the levers connected to the sabot, thereby exerting an upward tension of the sabot, and the latter, combined with the flexing of the patient's knee, exerts a predetermined traction on the tendon or muscle to be treated.

14 Claims, 3 Drawing Figures

20
22
18
16
14
26
58
56
30
54
23
24
28
12

70
64
20
68
60
66
80
Tn
T
76
16
74
72
52
78
62

PHYSIOTHERAPEUTIC SELF-EXERCISER

FIELD OF THE INVENTION

The present invention pertains to a physiotherapeutic self-exerciser whereby a patient may exert himself the necessary tension which is required to exercise a tendon or muscle to be treated.

BACKGROUND OF THE INVENTION

In the field of rehabilitation, physiotherapists and other specialists are using methods of treatment related to various elements of the muscular system. A large number of patients are suffering from various types of myopathy and are experimenting hardening of the Achilles tendon or similar disorders. In order to offset this phenomenon which sometimes minifests itself during very long periods, the patient must enter into a regular program of special exercises applied to the tendons by a specialist or by the patient's relatives. These programs are quite tedious and require time and effort on the part of the persons involved.

OBJECTS AND STATEMENT OF THE INVENTION

It is an object of the present invention to propose an exercising apparatus which allows the patient himself to apply the treatment, thus freeing all those involved in the treatment from a very time-consuming task.

The present invention rests essentially on the utilization of the gravitational force or, more specifically on the weight of the patient, to obtain the necessary effort required in the treatment of myopathy or like therapy. In general, patients cannot exert an important muscular effort but they can however apply, without difficulty, through the use of an appropriate mechanism, the effort required for a prescribed treatment.

It is a further object of the present invention to provide an apparatus where the patient can personally control the intensity of the effort throughout the duration of these exercises.

In the apparatus of the present invention, the foot is solidly tied to a sabot pivoting around an axis associated with a base. On an appropriate support affixed to this base, a system of levers is articulated and tied to a predetermined point of the sabot structure. While flexing his knee, the patient gradually applies his weight to the lever system which exerts an important upward tension on the sabot. The tension, combined with the flexing of the knee, exerts the required traction on the affected tendon.

The present invention therefore relates, in its broadest aspect, to a physiotherapeutic self-exerciser which comprises a base; a sabot pivotably mounted relative to the base; support means associated with this base; lever means mounted to the support and being articulated relative to the support, the lever means having one end actuatable by the patient so that he may use his weight to articulate the lever means; and tie means connecting the other end of the lever means to the toe end of the sabot.

In one particular form of the invention, the sabot includes means for limiting the angle of rotation of the ankle.

In a further embodiment of the invention, means are provided to measure the degree of traction exerted on the tendon by the patient.

Other objects and advantages of the present invention will become apparent from the following description of embodiments of the invention. It should be noted, however, that various modifications can be brought to these embodiments without departing from the scope of the appending claims.

DESCRIPTION OF PREFERRED EMBODIMENTS

Figure 1:
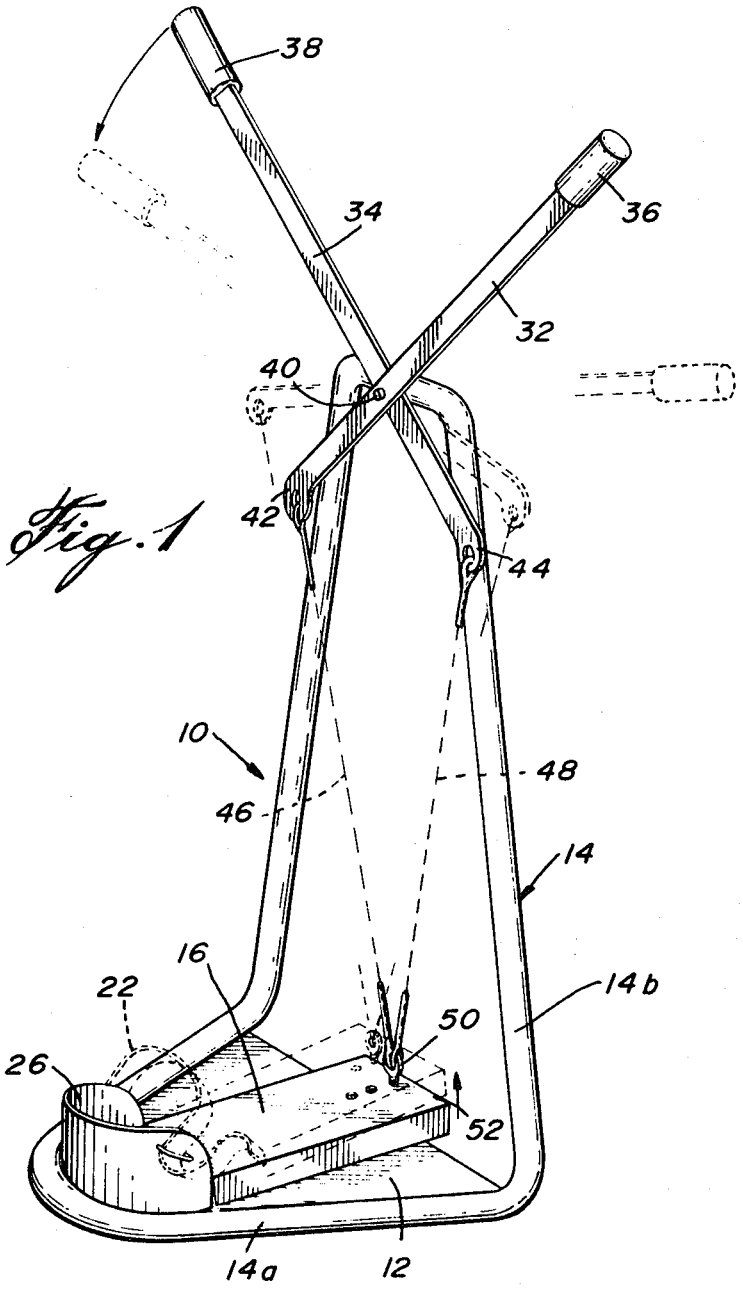
FIG. 1 is a perspective view of a self-exerciser made in accordance with the present invention.
Figure 2:
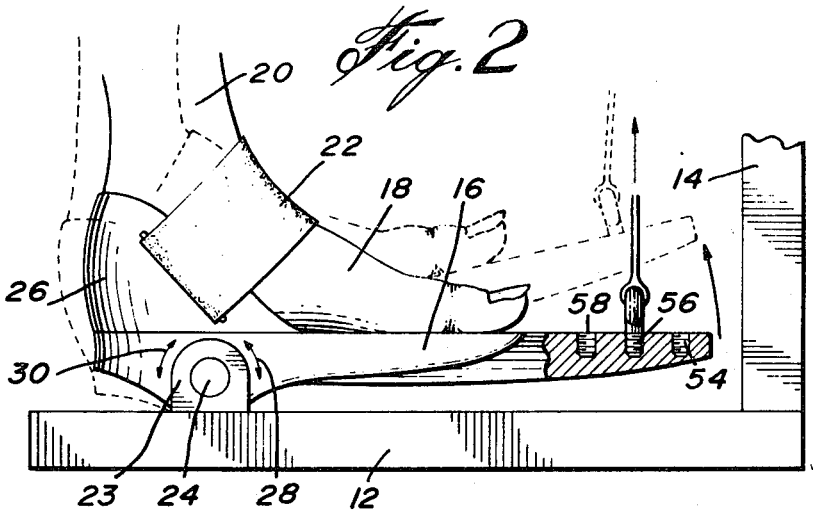
FIG. 2 is an elevational view showing the bottom portion of the exerciser with a patient's foot attached thereon.

Referring to FIGS. 1 and 2, there is shown a first embodiment of a physiotherapeutic self-exerciser 10 made in accordance with the present invention. It comprises a base 12 to which is associated a support 14 having a lower portion **14*a* partially surrounding the base 12 and an upstanding vertical portion 14*b*. To the upper face of the base 12 is mounted a sabot 16 which is adapted to receive the foot 18 of a patient's leg 20. Fastening means, such as belt 22, solidly fixes the foot to the sabot 16. The ankle portion of the sabot is connected to a pair of ears 23 integral with the top face of the base through a pin 24. The pivot 24 is preferably located in vertical alignment with the ankle of the patient's foot which can pivot in the direction shown by arrows 28 and 30. In the embodiment illustrated, the sabot includes a heel rest 26**.

As illustrated in FIG. 1, a lever system is mounted to the vertical support 14 and consists of a pair of levers 32 and 34, each provided with a handle 36, 38 respectively. The levers are mounted to the vertical support by means of a pin 40 in a scissor-like arrangement and are jointly articulatable about axis 40. The opposite extremities 42, 44 of levers 32, 34 are adapted to tightly receive tie members 46, 48 which serve to connect the levers to a bolt 50 fixed to the toe end 52 of the sabot. These tie members may be flexible such as a cable, or rigid such as tension rods and may be fixed or adjustable in length.

In the embodiment illustrated in FIG. 2, bolt 50 may be engaged in one of three threaded cavities 54, 56 and 58 permitting various connections of the tie members with the sabot.

In operation, foot 18 is solidly tied by means of belt 22 to the sabot 16. The patient slightly flexes his knee and then gradually applies his weight to the lever system by forcing downward levers 32 and 34. This results in an upward tension on sabot 16 which pivots about pin 24. This tension combined with the flexing of the knee exerts the required traction on the affected tendon.

Figure 3:
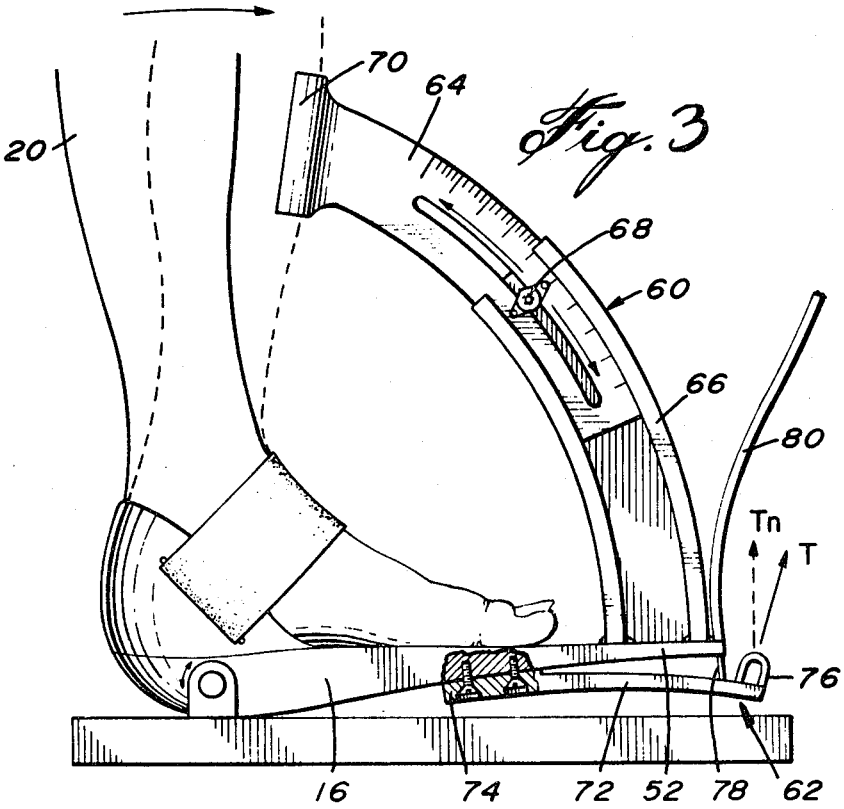
FIG. 3 is an elevational view showing other embodiments of the present invention including traction limiting means and traction measuring means.

Referring to FIG. 3, two additional attachments, generally denoted 60 and 62, may form part, singly or in combination, of the exerciser 10.

Attachment 60 consists of an adjustable mechanism which is tightly secured to the toe end 52 of the sabot to limit the exercising to a desired degree of ankle rotation. This mechanism comprises two telescoping parts 64 and 66 with part 64 being adjustably displaceable within part 66 through the use of a tightening screw 68. Part 64 displays graduation lines 65 and includes a padded extremity 70 which contacts the patient's leg 20. By contacting extremity 70, the patient is prevented from exceeding a prescribed angle of rotation for the ankle, thus avoiding any possible damage to the Achilles tendon to be treated. Even if undue traction is accidentally applied on the sabot, the front of the leg will stop and rest upon the adjustable part of the attachment.

Attachment 62 includes a cantilevered beam 72 which is fixedly secured at its end 74 to the sabot 16. The other end receives a hook 76 to which are connected tension tie members such as those illustrated as 46 and 48 in FIG. 1. A flexible shaft 78 is secured, at one end, to beam 72 and extends upward through a casing 80. The opposite end of the shaft 78 is connected to a dial which may be mounted at the top of the support 14. Attachment 62 serves to measure the normal component "Tn" of the traction applied (thus the torque applied) to the sabot. The deflection of the cantilevered beam is directly proportional to "Tn" and is transfered to the flexible shaft 78 resting on its end. By sliding within its casing 80, shaft 78 activates the dial at the other end of the casing 80 in such a way that "Tn" is directly read on the dial.

Attachments 60 and 62 enable the physician and the patient to closely control the various steps of the treatment and to measure with great accuracy any improvement in the muscle or tendon flexibility.

In another particular form of the invention, the sabot may include means for measuring the angle of rotation of the ankle and the degree of traction-exerted on the tendon in such a way as to plot the curve of the angle of rotation versus the applied traction in order, for example, to establish the tendon elasticity for diagnostic or therapeutic purposes.

What is claimed is:

1. A physiotherapeutic self-exerciser to enable a patient to apply himself traction to the muscles or tendons of his foot comprising:

a base;

a sabot pivotably mounted relative to said base, said sabot adapted to fixedly receive the foot of the patient, said sabot having a toe end and an ankle end;

support means for supporting said self-exerciser, and associated with said base;

lever means mounted to said support means and being articulatable relative to said support, said lever means having one end actuatable by the patient so that the latter may use his weight to articulate said lever means; and tie means connecting the other end of said lever means to said toe end of said lever means whereby the patient, by gradually applying his weight to the lever means, exerts a tension of the sabot, said tension exerting traction to the foot muscle or tendon to be treated;

said lever means consisting essentially of a pair of levers in scissor-like arrangement, each lever having one end manually engageable by the patient and the other end connected to said tie means.

2. A self-exerciser as defined in claim 1, further comprising limiting means mounted at the toe end of the sabot engaging the patient's leg to prevent the ankle from exceeding a prescribed angle of rotation during exercising.

3. A self-exerciser as defined in claim 2, wherein said limiting means comprise an arc-shaped member having one end fixedly mounted to the toe end of said sabot and the opposite upper end adapted to contact the patient's leg; said member consisting of two telescopically engaged parts.

4. A self-exerciser as defined in claim 3, means for adjusting the relative position of said parts to one another to provide various angles of rotation of the ankle; one of said parts displaying a scale thereon.

5. A self-exerciser as defined in claim 1, comprising means for measuring the traction exerted on the patients tendons during exercising.

6. A self-exerciser as defined in claim 5, wherein said measuring means include a cantilevered beam attached to the toe end of the sabot; said tie means having the lower end thereof attached to said beam; a dial; and means on said beam for registering on said dial the displacement of said beam when said lever means is activated

7. A physiotherapeutic self-exerciser to enable a patient to apply himself traction to the muscles or tendons of his foot comprising:

a base;

a sabot pivotably mounted relative to said base, said sabot adapted to fixedly receive the foot of the patient, said sabot having a toe end and an ankle end;

support means for supporting said self-exerciser, and associated with said base;

lever means mounted to said support means and being articulatable relative to said support, and lever means having one end actuatable by the patient so that the latter may use his weight to articulate said lever means; and tie means connecting the other end of said lever means to said toe end of said lever means whereby the patient, by gradually applying his weight to the lever means, exerts a tension of the sabot, said tension exerting traction to the foot muscle or tendon to be treated; and limiting means mounted at the toe end of the sabot engaging the patient's leg to prevent the ankle from exceeding a prescribed angle of rotation during exercising.

8. A self-exerciser as defined in claim 1 or 7, further comprising means on said sabot for adjusting the connection of said tie means to said toe end of said sabot.

9. A self-exerciser as defined in claim 1 or 7, wherein said support means include a horizontally extending pivot disposed adjacent the ankle end of said sabot and in substantially vertical alignment with the ankle of the patient.

10. A self-exerciser as defined in claims 1 and 7, further comprising fastening means secured to said sabot for solidly attaching the foot of the patient to the sabot.

11. A self-exerciser as defined in claim 7 wherein said limiting means comprise an arc-shaped member having one end fixedly mounted to the toe end of said sabot and the opposite upper end adapted to contact the patient's leg; said member consisting of two telescopically engaged parts.

12. A self-exerciser as defined in claim 11, means for adjusting the relative position of said parts to one another to provide various angles of rotation of the ankle; one of said parts displaying a scale thereon.

13. A physiotherapeutic self-exerciser to enable a patient to apply himself traction to the muscles or tendons of his foot comprising:

a base;

a sabot pivotably mounted relative to said base, said sabot adapted to fixedly receive the foot of the patient, said sabot having a toe end and an ankle end;

support means for supporting said self-exerciser, and associated with said base;

lever means mounted to said support means and being articulatable relative to said support, said lever means having one end actuatable by the patient so that the latter may use his weight to articulate said lever means; and tie means connecting the other end of said lever means to said toe end of said lever means whereby the patient, by gradually applying his weight to the lever means, exerts a tension of the sabot, said tension exerting traction to the foot muscle or tendon to be treated; and means for measuring the traction exerted on the patient's tendons during exercising.

14. A self-exerciser as defined in claim 13, wherein said measuring means include a cantilevered beam attached to the toe end of the sabot; said tie means having the lower end thereof attached to said beam; a dial; and means on said beam for registering on said dial the displacement of said beam when said lever means is activated.

* * * * *